US007383818B1

(12) United States Patent
Beardmore

(10) Patent No.: US 7,383,818 B1
(45) Date of Patent: Jun. 10, 2008

(54) FUEL INJECTOR WITH SECONDARY COMBUSTION SEAL

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/696,201

(22) Filed: Apr. 4, 2007

(51) Int. Cl.
*F02M 61/14* (2006.01)
*F02M 61/18* (2006.01)

(52) U.S. Cl. ..... 123/470; 239/533.11

(58) Field of Classification Search ..... 123/470, 123/467, 468, 469; 239/533.11; 277/591, 277/626, 644
See application file for complete search history.

(56) References Cited

U.S. PATENT DOCUMENTS 4,813,600 A * 3/1989 Shultz et al. ..... 239/88
5,121,731 A * 6/1992 Jones ..... 123/470
5,156,129 A * 10/1992 Sumida et al. ..... 123/470
5,345,913 A * 9/1994 Belshaw et al. ..... 123/470
6,186,123 B1 * 2/2001 Maier et al. ..... 123/470
6,491,026 B1 * 12/2002 Andorfer ..... 123/470
6,817,341 B2 * 11/2004 Scheffel ..... 123/470
7,069,908 B2 * 7/2006 Ohkubo et al. ..... 123/470
2005/0066942 A1 * 3/2005 Ohkubo et al. ..... 123/470
2007/0113828 A1 * 5/2007 Fonville et al. ..... 123/470

* cited by examiner

*Primary Examiner*—Mahmoud Gimie

(57) ABSTRACT

A fuel injector assembly sufficiently configured to be mountable within an injector bore defined by a cylinder head assembly is provided. The fuel injector assembly includes an injector body having an injector tip portion and a generally annular combustion seal mounted with respect to the injector tip portion. A secondary combustion seal is mounted with respect to the injector tip portion and is substantially adjacent to the generally annular combustion seal. A cylinder head assembly incorporating the disclosed fuel injector assembly is also provided.

22 Claims, 2 Drawing Sheets

FUEL INJECTOR WITH SECONDARY COMBUSTION SEAL

TECHNICAL FIELD

The present invention relates to a fuel injector having a secondary combustion seal.

BACKGROUND OF THE INVENTION

Recent advances in fuel delivery and combustion research have allowed direct injection, or DI, fuel delivery systems to increase in popularity. The DI fuel delivery system provides a fuel injector within a cylinder head of an internal combustion engine. The fuel injector operates to inject a predetermined amount of fuel directly into the combustion chamber. The DI fuel delivery system enables higher power levels, improved fuel economy, and lower emissions. These beneficial aspects of the DI fuel delivery system are a result of the precise metering of the fuel injected into the combustion chamber as well as improved intake airflow into the combustion chamber.

Since the fuel injector assembly is in direct communication with the combustion chamber, the fuel injector is subject to high pressure loads and temperatures of the combustion process. Therefore, the fuel injector must be sealed with respect to the cylinder head to prevent combustion gases from leaking past the fuel injector.

SUMMARY OF THE INVENTION

A fuel injector assembly sufficiently configured to be mountable within an injector bore defined by a cylinder head assembly is provided. The fuel injector assembly includes an injector body having an injector tip portion and a generally annular combustion seal mounted with respect to the injector tip portion. A secondary combustion seal is mounted with respect to the injector tip portion and is substantially adjacent to the generally annular combustion seal. The secondary combustion seal is preferably an o-ring type seal. The injector bore may include a tapering portion and a generally cylindrical portion. The generally annular combustion seal and the secondary combustion seal are preferably configured to sealingly engage the generally cylindrical portion. A cylinder head assembly incorporating the disclosed fuel injector assembly is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
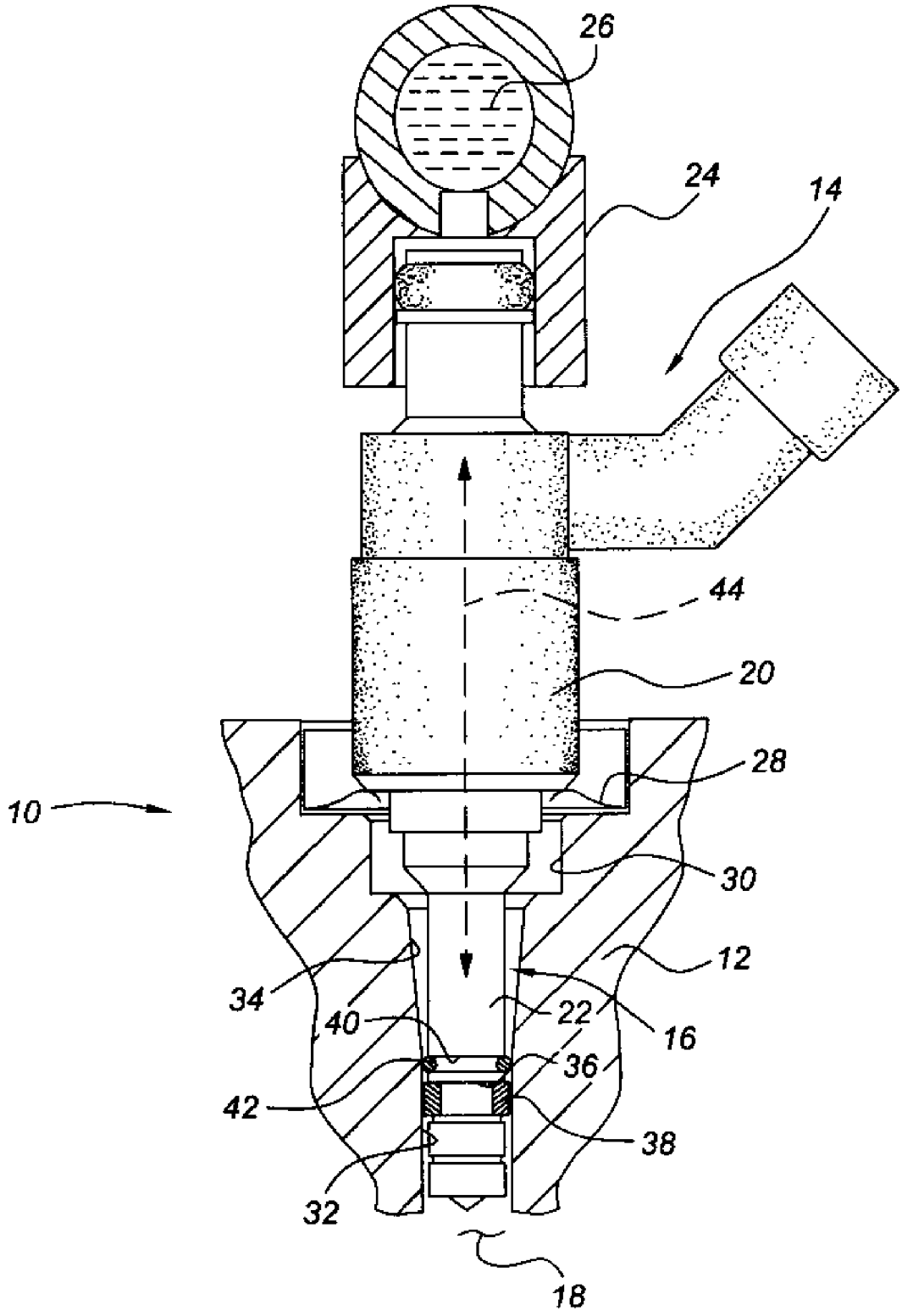
FIG. 1 is a sectional view of a portion of a cylinder head assembly with a fuel injector assembly mounted thereto and illustrating a secondary combustion seal.

Referring to the drawings wherein like reference numbers correspond to like or similar components throughout the several figures, there is shown in FIG. 1 a portion of a cylinder head assembly 10 for a direct injection internal combustion engine, not shown. The cylinder head assembly 10 includes a cylinder head 12, formed from a cast metal such as aluminum, iron, magnesium, etc., and a fuel injector assembly 14 mounted thereto. The cylinder head 12 defines an injector bore 16 and a partially defines a combustion chamber 18. The injector bore 16 is in communication with the combustion chamber 18. The fuel injector assembly 14 includes an injector body 20 having an injector tip portion 22. The injector bore 16 is configured to receive the injector tip portion 22 such that the injector tip portion 22 is in communication with the combustion chamber 18.

A fuel rail 24 is mounted with respect to the fuel injector assembly 14 and is operable to provide a source of pressurized fuel 26 to the fuel injector assembly 14. The fuel injector assembly 14 is operable to communicate metered and timed amounts of pressurized fuel 26 from the fuel rail 24 directly into the combustion chamber 18 for subsequent combustion therein. As such, the fuel injector assembly 14 may be characterized as a direct injection fuel injector assembly. An isolator member 28 is disposed between the cylinder head 12 and the fuel injector assembly 14 and is operable to provide a measure of compliance to reduce or eliminate hard contact or grounding between the fuel injector assembly 14 and the cylinder head 12. In so doing, the transmission of noise producing vibrations between the fuel injector assembly 14 and the cylinder head 12 is reduced.

The injector bore includes first and second generally cylindrical portions 30 and 32, respectively, having a generally tapering bore portion 34 therebetween. The generally tapering bore portion 34 is operable to guide or pilot the injector tip portion 22 into the second generally cylindrical portion 32 during insertion of the fuel injector assembly 14. The injector tip portion 22 defines an annular groove 36 configured to receive a portion of a combustion seal 38. The combustion seal 38 is generally annular and sleeve-like in shape and is operable to sealingly engage the second generally cylindrical portion 32 of the injector bore 16 thereby preventing combustion gases from within the combustion chamber 18 from traversing the injector bore 16 during operation of the engine. The combustion seal 38 is preferably formed from a glass or carbon filled polytetrafluoroethylene material, however, those skilled in the art will recognize that other materials may be employed possessing the requisite thermal and chemical resistance while remaining within the scope of that which is claimed.

An annular groove 40 is defined by the injector tip portion 22 and is configured to contain a portion of a secondary combustion seal 42. The secondary combustion seal 42 is mounted substantially adjacent to the combustion seal 38 and is operable to sealingly engage the second generally cylindrical portion 32 of the injector bore 16. The secondary combustion seal 42 is operable to prevent combustion gases that may traverse the combustion seal 38 from flowing further into the injector bore 16. The secondary combustion seal 42 is preferably an o-ring type seal formed from a rubber. In a preferred embodiment the secondary combustion seal 42 is formed from a fluoropolymer elastomer material.

In operation, the fuel injector assembly 14 will exhibit small axial displacements or movements, as illustrated by arrow 44, as a result of variations in pressure within the combustion chamber 18 and the pressurized fuel 26 within the fuel rail 24. The isolation member 28 may tend to increase the magnitude of this movement. The axial movements of the fuel injector assembly 14 may tend to destabilize the combustion seal 38 thereby causing a reduction in the sealing effectiveness of the combustion seal 38. The secondary combustion seal 42 is operable to maintain a seal between the injector tip portion 22 and the second generally cylindrical portion 32 of the injector bore 16 during the axial movement of the fuel injector assembly since the o-ring shape of the secondary combustion seal 42 will allow the secondary combustion seal 42 to "roll" within the annular groove 40 while maintaining engagement with the injector bore 16.

Figure 2:
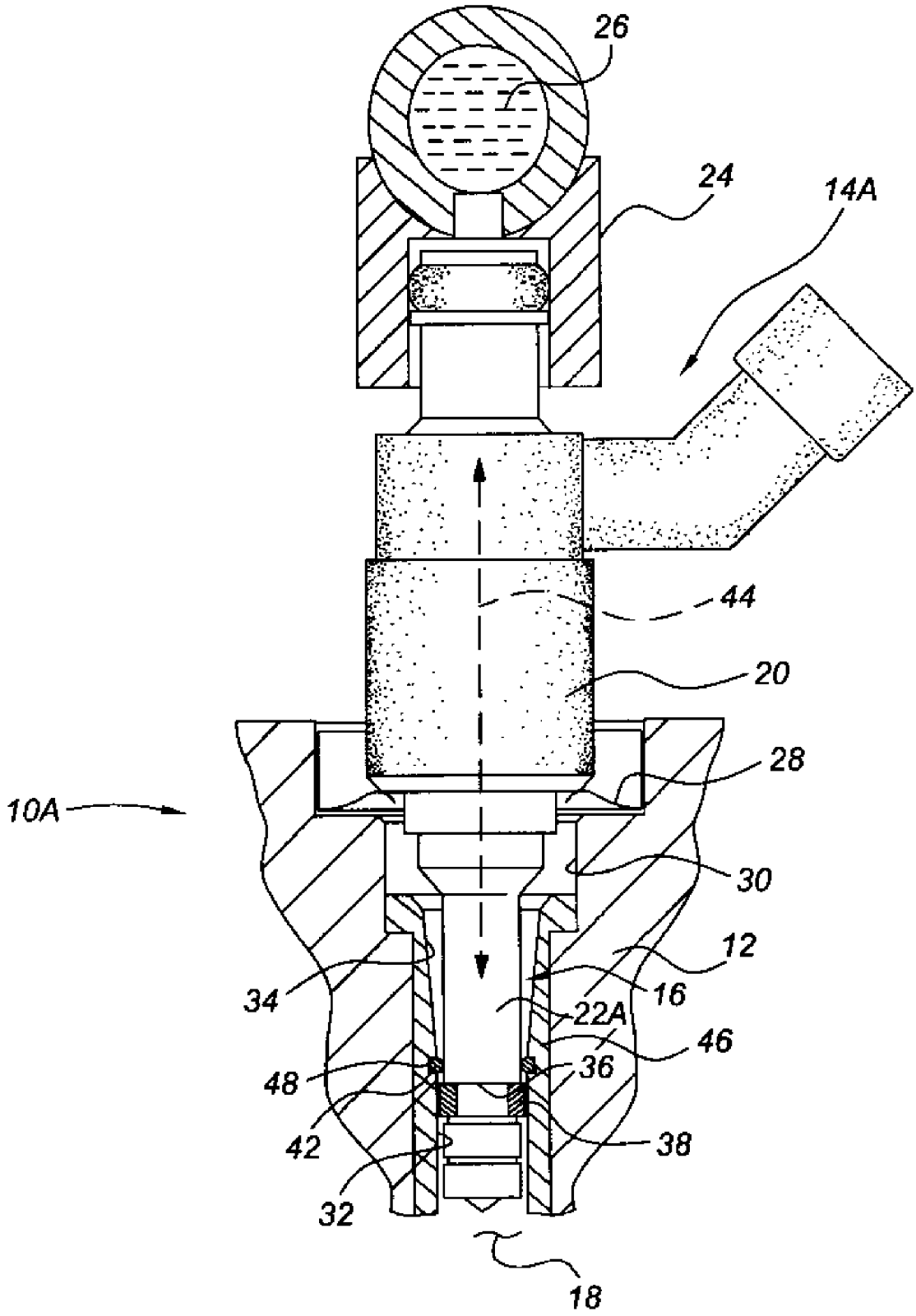
FIG. 2 is a sectional view of a portion of a cylinder head assembly with a fuel injector assembly mounted thereto and illustrating an alternate embodiment of the secondary combustion seal of FIG. 1.

Referring now to FIG. 2, there is shown an alternate embodiment of the cylinder head assembly 10 of FIG. 1, generally indicated at 10A. The cylinder head assembly 10A includes a fuel injector assembly 14A. The fuel injector assembly 14A includes the injector body 20 having an injector tip portion 22A. The annular groove 40 defined by injector tip portion 22 of FIG. 1 is absent in the injector tip portion 22A of FIG. 2. An injector piloting sleeve 46 is mounted with respect to the cylinder head 12 and defines the generally tapering bore portion 34 and the generally cylindrical bore portion 32 of the injector bore 16. The injector piloting sleeve 46 may be retained within the cylinder head 12 by interference fit, threaded engagement, or other fastening means known to those skilled in the art. The injector piloting sleeve 46 defines an annular groove 48 configured to receive a portion of the secondary combustion seal 42. In this configuration, the secondary combustion seal 42 sealingly engages the injector tip portion 22A of the fuel injector assembly 14A. The annular groove 48 is preferably formed in the second generally cylindrical bore portion 32 such that when the fuel injector assembly 14A is mounted with respect to the cylinder head 12, the secondary combustion seal 42 is substantially adjacent to the combustion seal 38. The secondary combustion seal 42 operates in substantially the same fashion as described hereinabove with reference to FIG. 1. Additionally, the injector piloting sleeve 46 may be formed from a material having a similar coefficient of thermal expansion as that of the injector tip portion 22A. In this case, close tolerances may be maintained between the second generally cylindrical bore portion 32 and the injector tip portion 22A over a wide range of temperatures. Furthermore, the piloting sleeve 46 may be formed without the annular groove 48 for use with the fuel injector assembly 14 of FIG. 1.

While the best modes for carrying out the invention have been described in detail, those familiar with the art to which this invention relates will recognize various alternative designs and embodiments for practicing the invention within the scope of the appended claims.

The invention claimed is:

1. A fuel injector assembly sufficiently configured to be mountable within an injector bore defined by a cylinder head assembly, the fuel injector assembly comprising:

an injector body having an injector tip portion;

a generally annular combustion seal having a first shape, mounted with respect to said injector tip portion; and a secondary combustion seal having a second shape dissimilar from said first shape, said secondary combustion seal mounted with respect to said injector tip portion and substantially adjacent to said generally annular combustion seal.

2. The fuel injector assembly of claim 1, further comprising an isolation member operable to isolate said fuel injector body from the cylinder head.

3. The fuel injector assembly of claim 1, wherein said secondary combustion seal is an o-ring seal.

4. The fuel injector assembly of claim 1, wherein said generally annular combustion seal and said secondary combustion seal are formed from different materials.

5. The fuel injector assembly of claim 4, wherein said generally annular combustion seal is formed from polytetrafluoroethylene.

6. The fuel injector assembly of claim 4, wherein said secondary combustion seal is formed from rubber.

7. The fuel injector assembly of claim 4, wherein said secondary combustion seal is formed from a fluoropolymer elastomer material.

8. The fuel injector assembly of claim 1, wherein the fuel injector assembly is a direct injection fuel injector assembly.

9. The fuel injector assembly of claim 1, wherein the injector bore includes a tapering portion and a generally cylindrical portion and wherein said generally annular combustion seal and said secondary combustion are configured to sealingly engage said generally cylindrical portion.

10. The fuel injector assembly of claim 1, wherein said injector tip portion defines an annular groove and wherein said secondary combustion seal is partially disposed within said annular groove.

11. The fuel injector assembly of claim 1, wherein the first shape is a sleeve-like shape having a substantially rectangular cross-section.

12. The fuel injector assembly of claim 11, the second shape having a substantially circular cross-section.

13. A cylinder head assembly comprising:

a cylinder head at least partially defining a combustion chamber and an injector bore;

a fuel injector assembly having an injector body and an injector tip portion;

wherein said injector tip portion is at least partially disposed within said injector bore and in communication with said combustion chamber;

a generally annular combustion seal having a first shape, mounted with respect to said injector tip portion and operable to at least partially seal said injector tip with respect to said injector bore; and an o-ring seal having a second shape dissimilar from said first shape, said o-ring seal mounted with respect to said injector tip portion and substantially adjacent to said generally annular combustion seal, said o-ring seal being operable to further seal said injector tip with respect to said injector bore.

14. The cylinder head assembly of claim 13, further comprising an isolation member operable to isolate said fuel injector body from said cylinder head.

15. The cylinder head assembly of claim 13, wherein said o-ring seal is formed from rubber.

16. The cylinder head assembly of claim 13, wherein said injector bore includes a tapering portion and a generally cylindrical portion and wherein said generally annular combustion seal and said o-ring seal engage said generally cylindrical portion.

17. A cylinder head assembly comprising:

a cylinder head at least partially defining a combustion chamber;

an injector piloting sleeve mounted within said cylinder head and defining an injector bore;

a fuel injector assembly having an injector body and an injector tip portion;

wherein said injector tip portion is at least partially disposed within the injector bore and in communication with said combustion chamber;

a generally annular combustion seal mounted with respect to said injector tip portion and operable to at least partially seal said injector tip with respect to said injector bore; and a secondary combustion seal substantially adjacent to said generally annular combustion seal, said secondary combustion seal being operable to further seal said injector tip with respect to said injector bore.

18. The cylinder head assembly of claim 17, wherein said secondary combustion seal is an o-ring seal.

19. The cylinder head assembly of claim 17, wherein said injector tip portion defines an annular groove and wherein said secondary combustion seal is partially disposed within said annular groove.

20. The cylinder head assembly of claim 17, wherein said injector piloting sleeve defines an annular groove and wherein said secondary combustion seal is partially disposed within said annular groove.

21. The cylinder head assembly of claim 17, wherein said injector bore includes a tapering portion and a generally cylindrical portion and wherein said generally annular combustion seal and said secondary combustion seal engage said generally cylindrical portion.

22. The cylinder head assembly of claim 17, said generally annular combustion seal having a first shape and said secondary combustion seal having a second shape dissimilar from said first shape.

* * * * *